US007949286B2

(12) United States Patent
Seorl

(10) Patent No.: US 7,949,286 B2
(45) Date of Patent: May 24, 2011

(54) DEVELOPMENT CARTRIDGE AND ELECTROPHOTOGRAPHIC IMAGE FORMING APPARATUS USING THE SAME

(75) Inventor: Kwoang-joe Seorl, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1433 days.

(21) Appl. No.: 11/407,931

(22) Filed: Apr. 21, 2006

(65) Prior Publication Data

US 2006/0275054 A1 Dec. 7, 2006

(30) Foreign Application Priority Data

Jun. 4, 2005 (KR) ..... 10-2005-0048114

(51) Int. Cl.
*G03G 15/08* (2006.01)

(52) U.S. Cl. ..... 399/258; 399/260

(58) Field of Classification Search ..... 399/258, 399/260, 262

See application file for complete search history.

(56) References Cited

U.S. PATENT DOCUMENTS 5,526,099 A * 6/1996 Katakabe ..... 399/258
5,708,939 A * 1/1998 Oikawa et al. ..... 399/252
2006/0239719 A1* 10/2006 Sur et al. ..... 399/258

FOREIGN PATENT DOCUMENTS

| | | |
|---|---|---|
| JP | 01-304478 | 12/1989 |
| JP | 04-198971 | 7/1992 |
| JP | 07-152238 | 6/1995 |
| JP | 2001-042645 | 2/2001 |
| JP | 2004-0037973 | 2/2004 |
| KR | 1991-0000435 | 1/1991 |
| KR | 2001-0061976 | 7/2001 |

* cited by examiner

*Primary Examiner* — David M Gray
*Assistant Examiner* — Erika Villaluna
(74) *Attorney, Agent, or Firm* — Roylance, Abrams, Berdo & Goodman, L.L.P.

(57) ABSTRACT

A development cartridge and an electrophotographic image forming apparatus using the same are provided. The development cartridge includes a reception unit including at least one auger. A toner supply unit is disposed on the reception unit and connects a toner cartridge with the reception unit. A transfer means transfers the toner supplied from the toner cartridge to the reception unit. The transfer means engages the at least one auger, and includes a plurality of main wings arranged radially about a rotation axis.

17 Claims, 5 Drawing Sheets

DEVELOPMENT CARTRIDGE AND ELECTROPHOTOGRAPHIC IMAGE FORMING APPARATUS USING THE SAME

CROSS-REFERENCE TO RELATED PATENT APPLICATION

This application claims the benefit under 35 U.S.C. §119 (a) of Korean Patent Application No. 10-2005-0048114, filed on Jun. 4, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a plurality of development cartridges which operate sequentially to form a color image, and an electrophotographic image forming apparatus using the development cartridges.

2. Description of the Related Art

Generally, in an electrophotographic image forming apparatus, light is irradiated onto a uniformly charged photosensitive medium to form an electrostatic latent image corresponding to a desired image, the electrostatic latent image is developed using toner to form a toner image, and the developed image is thereafter transferred and fused onto paper to form the desired image.

Typically, cyan, magenta, yellow and black (CMYK) images are superimposed in a color image forming apparatus to form a desired color image. The color image forming apparatus, therefore, requires four development cartridges to store the four colors of toner, respectively.

A color image forming apparatus including the four development cartridges is not only larger but is more complex than a monochrome image forming apparatus for forming a single color image.

Also, when the development cartridge stores toner, various other components, such as a development roller for developing the electrostatic latent image and the like, are included in the cartridge. After the toner is used up, the development cartridge must be replaced with another development cartridge containing new toner.

The other components, however, have much longer lifespans than the toner, and it is not economical to replace the development cartridge when only the toner has been consumed and the other components still have remaining useful lifespans.

Therefore, there is a need for a method of using the entire development cartridge for its full usable lifespan, in which only additional toner is supplied to the cartridge. This involves separating the toner cartridge and the development cartridge, and supplying new toner by replacing the toner cartridge while using the development cartridge until the end of its lifetime.

When the toner cartridge is detachable from the development cartridge, however, there are problems associated with effectively locating four development cartridges and toner cartridges in the image forming apparatus, and problems associated with reliably supplying the toner stored in the toner cartridge to the development cartridge.

In the latter case, the toner is typically supplied from the toner cartridge to the development cartridge by the free-fall method. In the free-fall method, the toner stored in the toner cartridge falls onto the development cartridge by gravity to supply the toner, and the toner must fall past the components of the development cartridge to reach the development roller.

The toner may not fall directly from the toner cartridge onto the components of the development cartridge, however, and in this case, the distance to the components of the development cartridge becomes long, and the toner is not readily available.

Accordingly, there is a need for an improved development cartridge that can reliably transfer toner from a toner cartridge to a development cartridge.

SUMMARY OF THE INVENTION

An aspect of the present invention is to address at least the above problems and/or disadvantages and to provide at least the advantages described below. Accordingly, an aspect of the present invention is to provide a development cartridge including a toner transfer unit that can transfer toner from a toner-supply aperture to a main development cartridge, so that the toner can be readily supplied from a toner cartridge to a development cartridge, and an electrophotographic image forming apparatus using the same.

According to an aspect of the present invention, a development cartridge for developing a photosensitive medium using toner supplied from a toner cartridge comprises a reception unit including at least one auger, a toner supply unit extending from the reception unit and connecting the toner cartridge with the reception unit, and a transfer means which transfers toner supplied from the toner cartridge to the reception unit. The transfer means is coupled to the at least one auger, and the transfer means includes a plurality of main wings arranged radially about a rotation axis.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1:
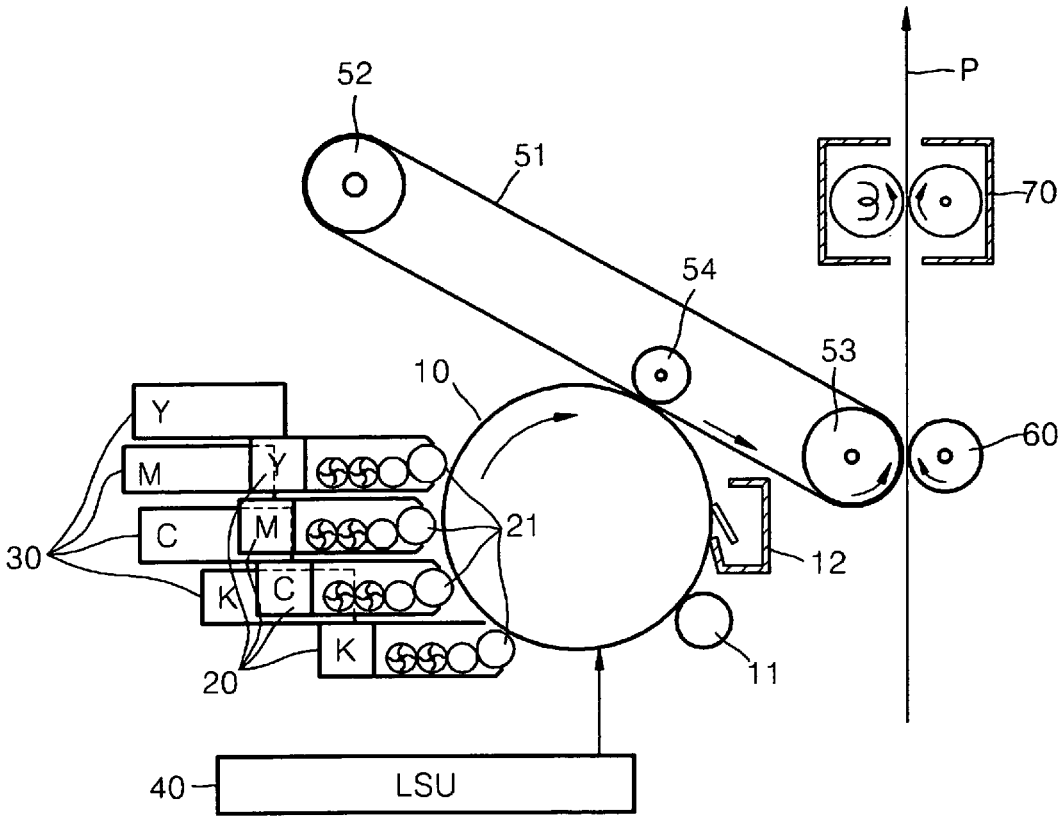
FIG. 1 is a schematic view of the structure of an electrophotographic image forming apparatus having a development cartridge that uses a transfer unit according to an exemplary embodiment of the present invention.

Referring to FIG. 1, an image forming apparatus includes a photosensitive drum 10, a plurality of development cartridges 20, a plurality of toner cartridges 30, an intermediate transfer belt 51, a first transfer roller 54, a second transfer roller 60, and a fuser 70.

The photosensitive drum 10 comprises, for example, a photoconductive layer formed on a cylindrical metal drum. Instead of the photosensitive drum 10, a photosensitive belt may also be used. A charge roller 11, which is an example of a charger to charge the photosensitive drum 10 to a uniform potential, is disposed near the surface of the photosensitive drum 10. In addition, a cleaning means 12 is provided for removing any toner remaining on the photosensitive drum 10 after transfer of an image from the drum 10.

The charge roller 11 rotates without contacting the photosensitive drum 10, so as to supply an electric charge so that the surface of the photosensitive drum 10 is charged to a uniform potential. Instead of the charge roller 11, a corona charger may also be used. An exposure unit 40 radiates light corresponding to image data onto the photosensitive drum 10 to form an electrostatic latent image. A typical exposure unit 40 is a laser scanning unit (LSU) that uses a laser diode as a light source.

The plurality of toner cartridges 30Y, 30M, 30C, and 30K respectively contain, for example, yellow Y, magenta M, cyan C, and black K toner. The plurality of development cartridges 20Y, 20M, 20C, and 20K receive the respective corresponding colors of toner from the plurality of toner cartridges 30Y, 30M, 30C, and 30K to develop the electrostatic latent image formed on the photosensitive drum 10.

The development cartridges 20 each include a development roller 21 which is separated from the photosensitive drum 10 by a development gap. The development gap is in the range of, for example, tens or hundreds of microns.

The image forming apparatus according to exemplary embodiment of the present invention may use, for example, a multi-pass method to form images. That is, the plurality of development cartridges 20Y, 20M, 20C, and 20K operate sequentially to form an image. In the multi-pass method, a development bias is applied to the development roller 21K of a selected development cartridge 20K. A development bias is not applied to the development rollers 21Y, 21M, and 21C of the other development cartridges 20Y, 20M and 20C, or an anti-development bias for preventing toner development may be applied to the other development rollers 21Y, 21M, and 21C. The development roller 21K of the selected development cartridge 20K rotates, and the development rollers 21 21Y, 21M, and 21C of the other development cartridges 20Y, 20M and 20C may not rotate. Thus, an image corresponding to the selected development cartridge 20K may be formed, and then the process may be repeated sequentially for each development cartridge.

Figure 2:
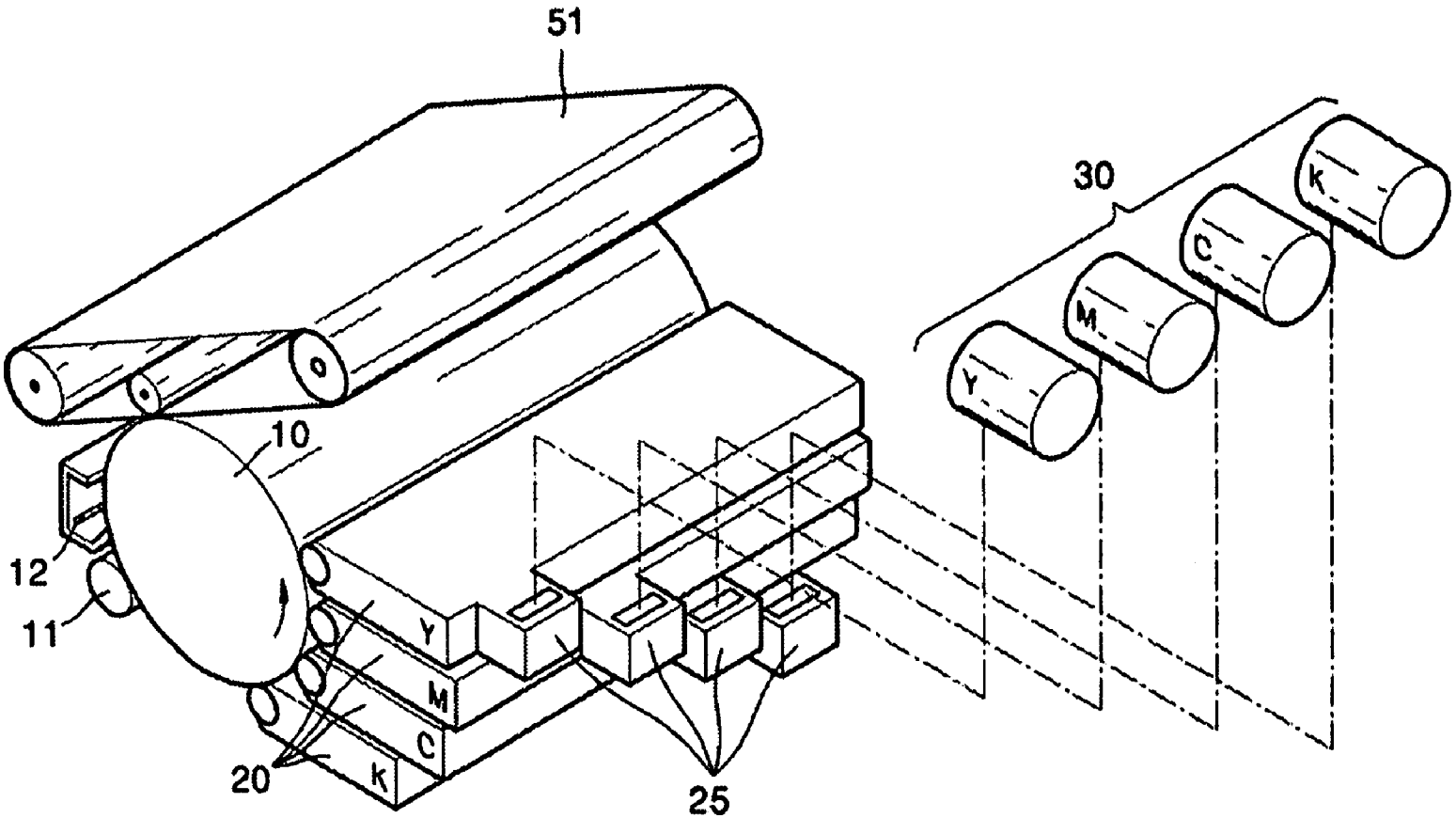
FIG. 2 is a perspective view of the layout of the toner supply units of a plurality of development cartridges shown in FIG. 1.
Figure 3:
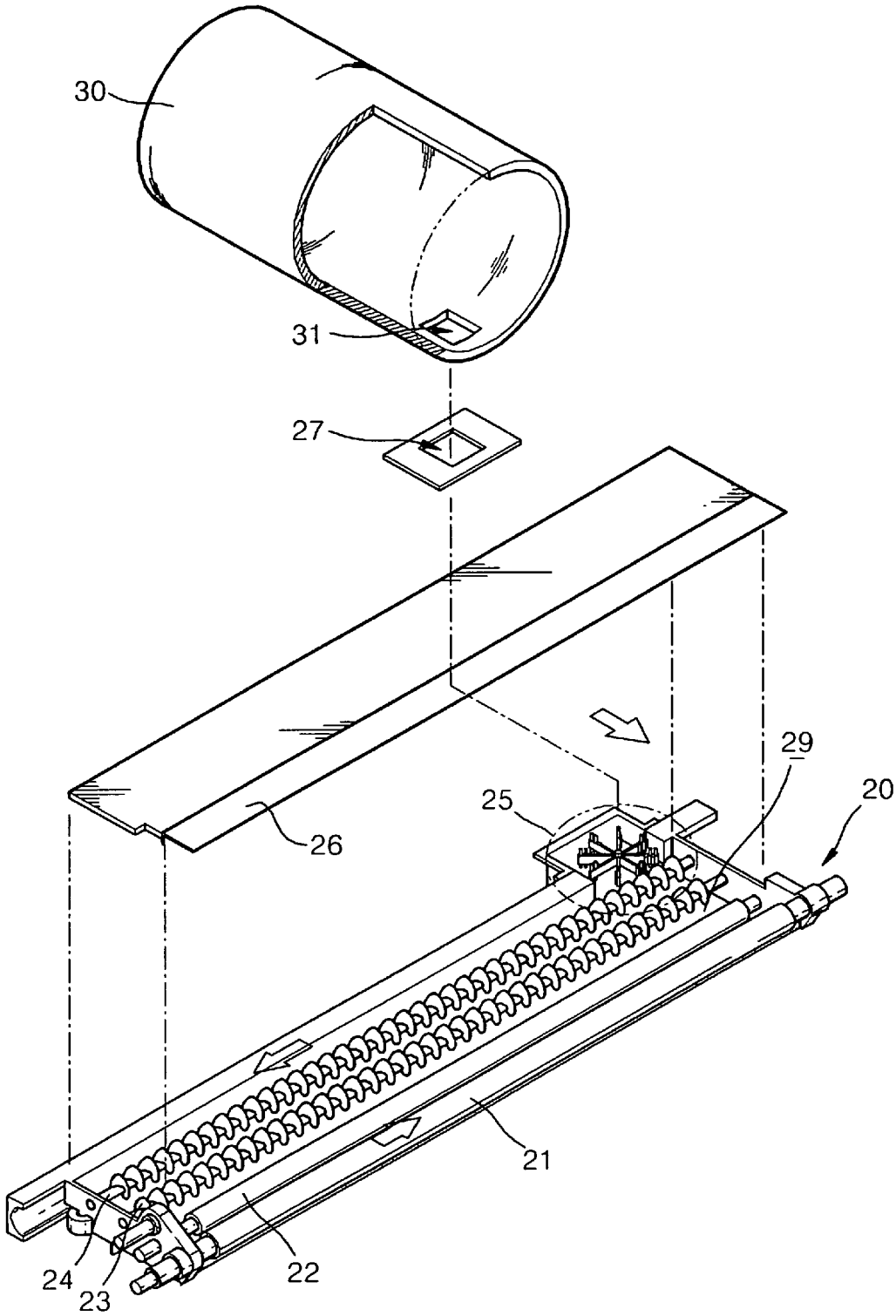
FIG. 3 is an exploded perspective view of the structures of a development cartridge and a toner cartridge shown in FIG. 1.
Figure 4:
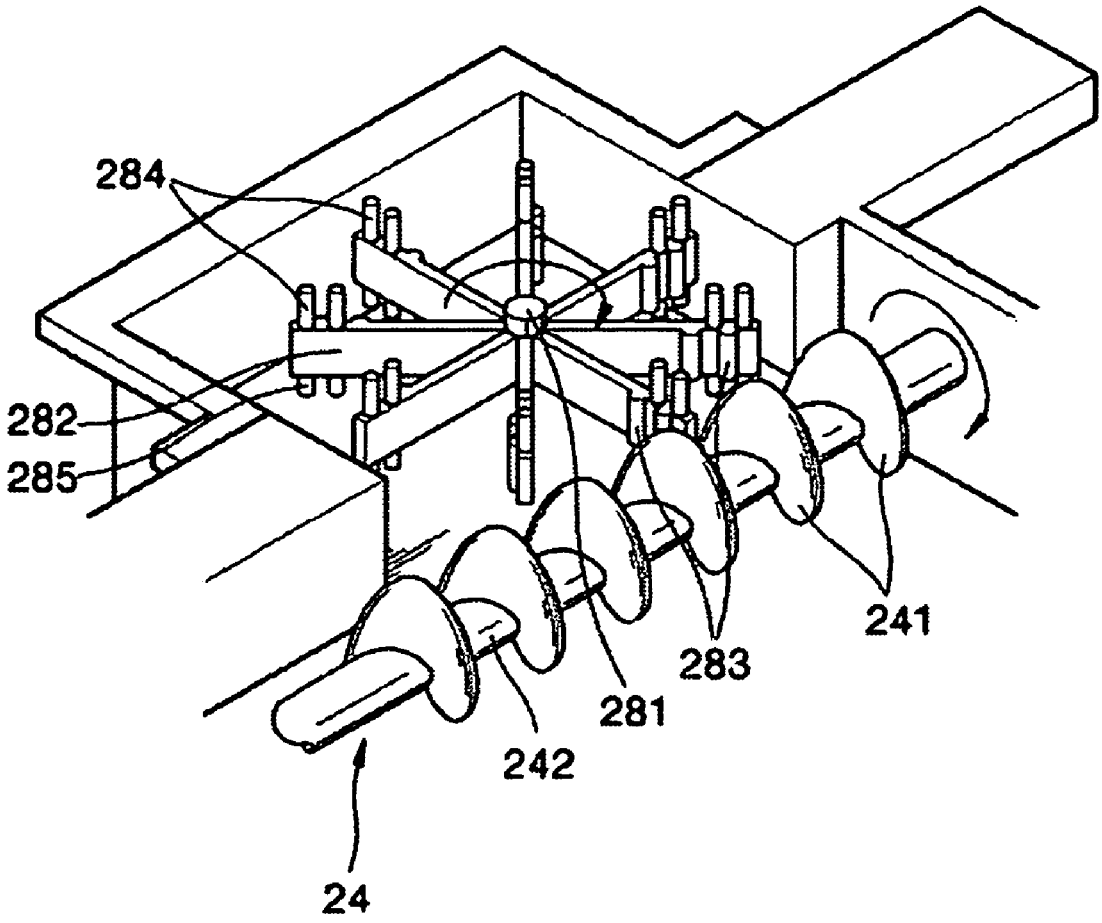
FIG. 4 is an enlarged perspective view of a portion of the transfer means shown in FIG. 3.
Figure 5:
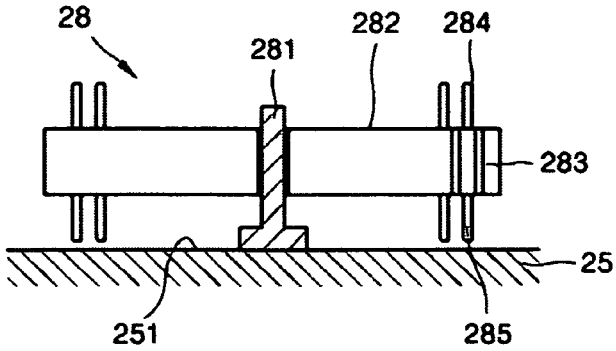
FIG. 5 is a sectional view of the transfer means shown in FIG. 3.
Figure 6:
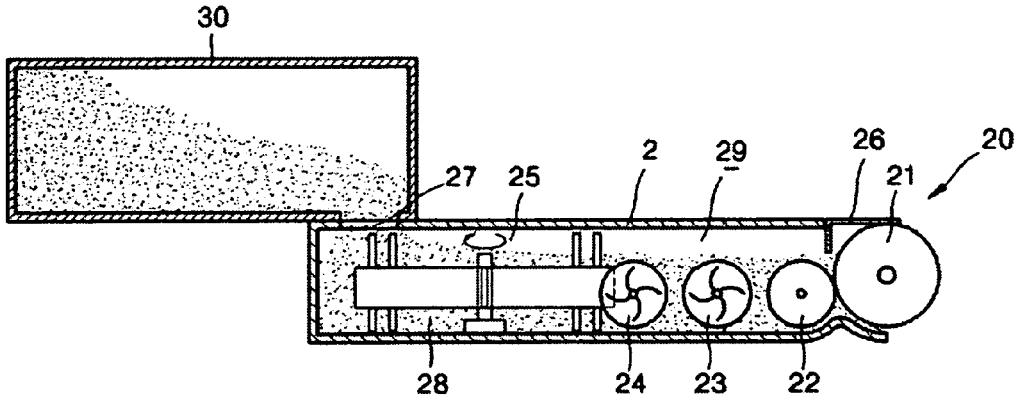
FIG. 6 is a sectional view of the development cartridge shown in FIG. 1.

The plurality of development cartridges 20Y, 20M, 20C, and 20K, as shown in FIG. 2, are substantially parallel to the axis of the photosensitive drum 10. The toner supply units 25Y, 25M, 25C, and 25K of the plurality of development cartridges 20Y, 20M, 20C, and 20K are offset from each other in a lengthwise direction of a reception unit 29, so that the plurality of toner cartridges 30Y, 30M, 30C, and 30K do not interfere with each other.

In the illustrated exemplary embodiment, the three development cartridges 20M, 20C, and 20K are positioned below the development cartridge 20Y. The development cartridges 20Y, 20M, 20C, and 20K may be positioned to minimize any height increase of the image forming apparatus caused by using a plurality of toner cartridges 30Y, 30M, 30C, and 30K. In addition, the development cartridges 20Y, 20M, 20C, and 20K may be configured to avoid any interference when the plurality of toner cartridges 30Y, 30M, 30C, and 30K are detached, or to avoid any interference between the plurality of development cartridges 20Y, 20M, 20C, and 20K and the plurality of toner cartridges 30Y, 30M, 30C.

Referring to FIGS. 3 through 6, each of the development cartridges 20 includes a development roller 21, a reception unit 29 to which a supply roller 22 and a plurality of augers 23 and 24 are provided, a toner supply unit 25 connecting the reception unit 29 and the toner cartridges 30, and a transfer means 28 for transferring toner to the reception unit 29.

The development roller 21 develops the electrostatic latent image formed on the photosensitive drum 10 using the toner. A regulating blade 26 is located at the upper side of the development roller 21 for controlling the thickness of the toner attached to the surface of the development roller 21.

The supply roller 22 rotates in contact with the development roller 21, so that toner (which is non-magnetic in the exemplary embodiment) is attached to the development roller 21 by friction charging.

The plurality of augers 23 and 24 supply toner from the toner supply unit 25 toward the development roller 21. The augers 23 and 24 have a rotation shaft 242 and a plurality of spiral-shaped flights 241 disposed on the rotation shaft 242. The plurality of augers 23 and 24 may be positioned so that their transfer directions are opposed.

The toner supply unit 25 is disposed on the reception unit 29 and may, for example, extend backwards from the reception unit. A supply aperture 27 is disposed at the upper side of the toner supply unit 25 to receive toner from the toner cartridges 30. The toner cartridge 30 has an outlet 31 which is coupled to the supply aperture 27. The toner cartridges 30 include a shutter (not shown) for opening and closing the outlet 31. When the toner cartridges 30 are placed into the development cartridges 20, the shutter opens the outlet 31, while when the toner cartridges 30 are separated from the development cartridges 20, the shutter closes the outlet 31.

The transfer means 28 is attached to the toner supply unit 25 in a rotatable manner, and includes a plurality of main wings 282, a plurality of auxiliary wings 283, and a plurality of protrusions 284 and 285.

The plurality of main wings 282 are arranged radially around a rotation shaft 281. The plurality of main wings 282 are positioned to intersect the flights 241 of the auger 24, so that when the auger 24 rotates, the flights 241 engage the main wings 282 to cause the plurality of main wings 282 to rotate in the direction indicated by the arrow in FIG. 4, and transfer toner toward the reception unit 29.

To allow the main wings 282 to operate while intersecting the rotation wings 241 of the auger 24, the main wings 282 are made of, for example, an elastically deformable material such as rubber or flexible plastic.

The plurality of auxiliary wings 283 protrude in the direction of rotation of the main wings 282 from the tips of the main wings 282. The plurality of auxiliary wings 283 transfer more toner while rotating along with the main wings 282. The auxiliary wings 283 may have various angles with respect to the main wings 282, and may form, for example, acute angles with respect to the main wings.

The plurality of protrusions 284 and 285 protrude from each of the upper and lower sides of the main wings 282. The upper protrusions 284 pass the lower side of the toner supply unit 25 to agitate toner that flows into the supply aperture 27 from the outlet 31, so that the toner falls into the toner supply unit 25. The lower protrusions 285 sweep the toner toward the reception unit 29 while passing along the bottom surface 251 of the toner supply unit 25.

The intermediate transfer belt 51 is supported by support rollers 52 and 53, so that its driving linear velocity is equivalent to the rotational linear velocity of the photosensitive drum 10. The length of the intermediate transfer belt 51 should be equal to or greater than that of the maximum size of paper P used in the image forming apparatus.

A first transfer bias is applied to the first transfer roller 54 that faces the photosensitive drum 10 to transfer a toner image from the photosensitive drum 10 to the intermediate transfer belt 51. The second transfer roller 60 faces the intermediate transfer belt 51. When the toner image is transferred from the photosensitive drum 10 to the intermediate transfer belt 51, the second transfer roller 60 is separated from the intermediate transfer belt 51. On the other hand, when the toner image is completely transferred to the intermediate transfer belt 51, the second transfer roller 60 is brought into contact with the intermediate transfer belt 51. A second transfer bias is applied to the second transfer roller 60 for transferring the toner image onto the paper P.

The fuser 70 applies heat and pressure to the toner image on the paper P to fuse the toner image onto the paper P.

Accordingly, in a development cartridge and an electrophotographic image forming apparatus using the same, a transfer means for transferring toner to a reception unit is provided to a toner supply unit, so that toner is readily supplied to ensure the integrity of image quality.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A development cartridge for developing a photosensitive medium using toner supplied from a toner cartridge, the development cartridge comprising:

a reception unit comprising at least one auger;

a toner supply unit connecting a toner cartridge with the reception unit; and transfer means, which transfers the toner supplied from the toner cartridge to the reception unit, the transfer means being coupled to the auger and comprising a plurality of main wings arranged radially about a rotation shaft;

wherein the main wings intersect the at least one auger to rotate.

2. The development cartridge of claim 1, wherein the reception unit comprises a plurality of augers.

3. The development cartridge of claim 1, wherein at least one of the plurality of main wings comprises at least one protrusion on at least one of upper and lower sides thereof.

4. The development cartridge of claim 1, wherein at least one of the plurality of main wings comprises at least one auxiliary wing protruding in a rotational direction.

5. The development cartridge of claim 4, wherein the at least one auxiliary wing forms an acute angle with respect to the at least one main wing.

6. The development cartridge of claim 1, wherein the transfer means is disposed on the toner supply unit.

7. An electrophotographic image forming apparatus including a photosensitive medium, a plurality of toner cartridges, and a plurality of development cartridges for developing the photosensitive medium using toner supplied from the plurality of toner cartridges, the electrophotographic image forming apparatus comprising:

a reception unit comprising a plurality of augers;

a toner supply unit disposed on the reception unit, the toner supply unit connecting a toner cartridge with the reception unit; and transfer means, which transfers the toner supplied from the toner cartridge to the reception unit, the transfer means being coupled to the augers and including a plurality of main wings arranged radially about a rotation shaft;

wherein the main wings intersect at least one of the plurality of augers to rotate.

8. The electrophotographic image forming apparatus of claim 7, wherein the reception unit comprises a plurality of augers.

9. The electrophotographic image forming apparatus of claim 7, wherein at least one of the plurality of main wings comprises at least one protrusion on at least one of an upper and lower side thereof.

10. The electrophotographic image forming apparatus of claim 7, wherein at least one of the plurality of main wings comprises at least one auxiliary wing protruding in a rotational direction.

11. The electrophotographic image forming apparatus of claim 10, wherein the at least one auxiliary wing forms an acute angle with respect to the at least one main wing.

12. The development cartridge of claim 7, wherein the transfer means is disposed on the toner supply unit.

13. A development cartridge for an image forming apparatus, comprising:

a development roller for developing images on a photosensitive drum in an image forming apparatus;

a reception unit comprising at least one auger for supplying toner to the development roller;

a toner supply unit disposed on the reception unit, the toner supply unit connecting a toner cartridge to the reception unit; and transfer means for transferring toner to the reception unit, the transfer means comprising a rotation shaft disposed in the reception unit and a plurality of wings disposed on the rotation shaft, the plurality of wings engaging the at least one auger so that the wings rotate to supply toner to the auger.

14. The development cartridge of claim 13, wherein the at least one auger comprises at least one flight which engages the plurality of wings.

15. The development cartridge of claim 13, at least one of the plurality of wings comprises at least one protrusion on an upper and lower side thereof.

16. The development cartridge of claim 13, wherein at least one of the plurality of wings comprises at least one auxiliary wing.

17. The development cartridge of claim 16, wherein the at least one auxiliary wing forms an acute angle with respect to the at least one main wing.

* * * * *